US011946237B1

(12) United States Patent
Hernandez-Zelaya

(10) Patent No.: US 11,946,237 B1
(45) Date of Patent: Apr. 2, 2024

(54) DRAIN P-TRAP

(71) Applicant: Rodolfo Hernandez-Zelaya, Tampa, FL (US)

(72) Inventor: Rodolfo Hernandez-Zelaya, Tampa, FL (US)

( * ) Notice: Subject to any disclaimer, the term of this patent is extended or adjusted under 35 U.S.C. 154(b) by 0 days.

(21) Appl. No.: 18/205,513

(22) Filed: Jun. 3, 2023

(51) Int. Cl.
*E03C 1/29* (2006.01)

(52) U.S. Cl.
CPC ..... *E03C 1/29* (2013.01)

(58) Field of Classification Search
CPC ..... E03C 1/29
USPC ..... 137/247.11, 247
See application file for complete search history.

(56) References Cited

U.S. PATENT DOCUMENTS 162,331 A * 4/1875 Foley ..... E03C 1/29 137/247.35
176,258 A * 4/1876 Foley ..... E03F 5/04 137/247.11
5,039,135 A * 8/1991 Palmer ..... E03F 7/00 285/179
8,813,774 B1 * 8/2014 Porter ..... F16K 13/10 137/247
2004/0034925 A1 * 2/2004 McAlpine ..... E03C 1/29 4/649
2004/0177439 A1 * 9/2004 Nunez ..... E03C 1/29 4/679
2009/0308463 A1 * 12/2009 Bacon ..... F16K 17/192 137/247

* cited by examiner

*Primary Examiner* — Minh Q Le
(74) *Attorney, Agent, or Firm* — Edward P Dutkiewicz

(57) ABSTRACT

There is an inflow pipe and an intermediate pipe and an outflow pipe forming a passageway there through. The intermediate pipe has an internal surface with a radius of curvature. The outflow pipe is coupled to the intermediate pipe. There is a baffle located within the passageway. The baffle has a lower extent which is a second distance from the first radius of curvature of the internal surface of the intermediate pipe. The second distance is less than the first distance of the radius of curvature of the intermediate pipe.

6 Claims, 3 Drawing Sheets

FIG. 3
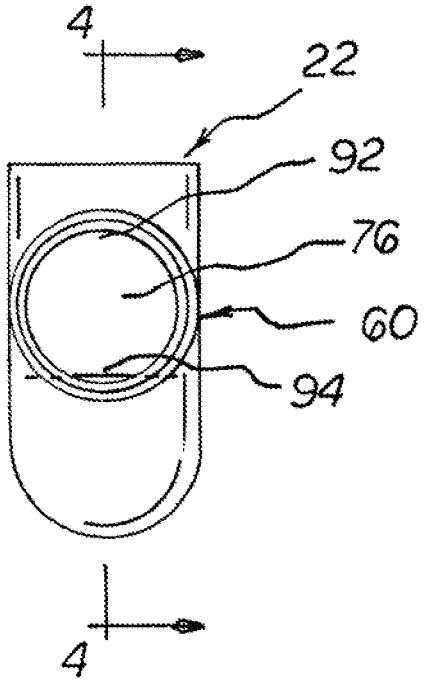
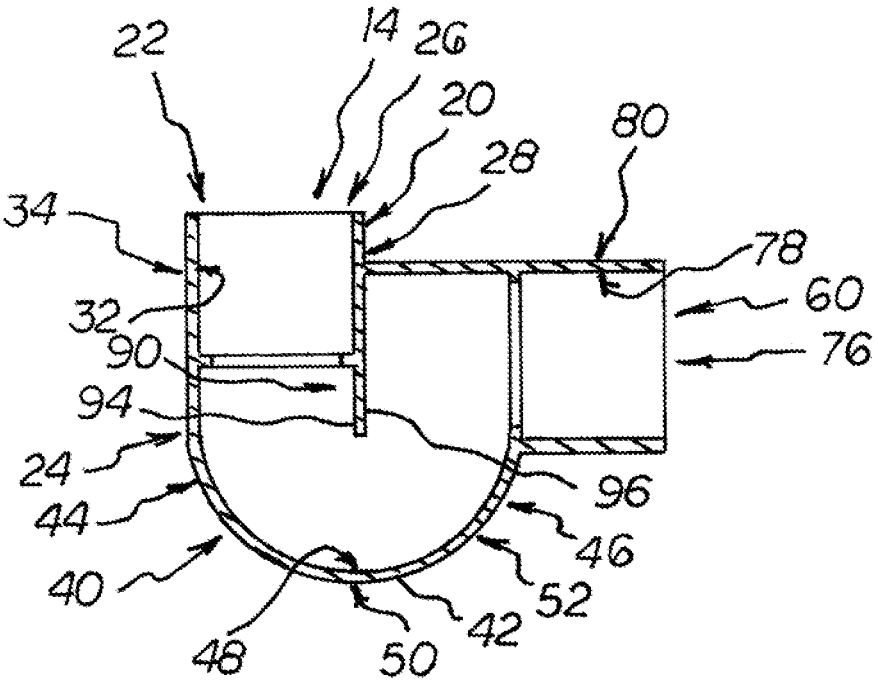
FIG. 4

DRAIN P-TRAP

BACKGROUND OF THE INVENTION

Rule 1.78(F) (1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

There are no cross referenced or related applications which are direct to, or related to, the present application.

There is no research of development of this application which is federally sponsored.

FIELD OF THE INVENTION

The present invention relates to a drain P-trap and more particularly pertains to a P-trap having an internal baffle.

DESCRIPTION OF THE PRIOR ART

The use of drain traps is known in the prior art. More specifically, drain traps previously devised and utilized for the purpose of providing a drain trap with a water seal are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe drain P-trap that allows a P-trap having an internal baffle.

In this respect, the drain P-trap, according to the present invention, substantially departs from the conventional concepts and designs of the prior art, and in doing so provides an apparatus primarily developed for the purpose of providing a P-trap having an internal baffle.

Therefore, it can be appreciated that there exists a continuing need for a new and improved drain P-trap which provides a P-trap having an internal baffle. In this regard, the present invention substantially fulfills this need.

SUMMARY OF THE INVENTION

In view of the foregoing disadvantages inherent in the known types of drain traps now present in the prior art, the present invention provides an improved drain P-trap. As such, the general purpose of the present invention, which will be described subsequently in greater detail, is to provide a new and improved drain P-trap which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

In describing aspects of the invention, the word "generally" may be used. The term, "generally" when used to describe a configuration means that the configuration includes those aspects which are within normal manufacturing parameters of acceptance. By way of example, the term "generally round" may be used. This should be interpreted to mean that the configuration may be perfectly round, but may also have a radius which is not exact, but is within the manufacturing parameters. For example, a basketball may be generally round, but not be perfectly round.

By adjacent to a structure is meant that the location is near the identified structure.

To attain this, the present invention essentially comprises a A drain P-trap, comprising several components, in combination is herein described.

There is first provided an inflow pipe. The inflow pipe has a first diameter. The inflow pipe has a round configuration. The inflow pipe has a continuous circumferential wall, with a rearward portion and a forward portion. The rearward portion of the inflow pipe has an upper extent and a lower extent. The forward portion of the inflow pipe has an upper extent and a lower extent.

The upper extent of the rearward portion of the inflow pipe and the upper extent of the forward portion of the inflow pipe are continuous, thereby forming a round opening of the inflow pipe. The inflow pipe has an internal surface and an external surface with a width there between.

There is next an intermediate pipe. The intermediate pipe has a lower surface. The intermediate pipe lower surface has a curved rearward portion and a curved forward portion. The curved rearward portion of the lower surface of the intermediate pipe is continuous with the lower extent of the rearward portion of the inflow pipe.

The intermediate pipe has an internal surface which is continuous with the internal surface of the inflow pipe. The intermediate pipe has an external surface which is continuous with the external surface of the inflow pipe.

The intermediate pipe has the width between the internal surface of the intermediate pipe and the external surface of the intermediate pipe. The intermediate pipe internal surface of the lower surface has a first radius of curvature.

There is an outflow pipe. The outflow pipe has the first diameter. The outflow pipe has a round configuration. The outflow pipe has a continuous circumferential wall, with an upper portion and a lower portion.

The upper portion of the outflow pipe has a forward extent and a rearward extent. The lower portion of the outflow pipe has a forward extent and a rearward extent. The forward extent of the upper portion of the outflow pipe and the forward extent of the lower portion of the inflow pipe are continuous with each other, thereby forming a round opening of the outflow pipe.

The upper portion of the outflow pipe and the lower portion of the outflow pipe have an internal surface and an external surface, with the width there between.

The radius of curvature of the internal surface of the intermediate pipe runs from the internal surface of the lower extent of the rearward portion of the inflow pipe to the internal surface of the rearward portion of the lower portion of the outflow pipe. The radius of curvature of the internal surface of the intermediate pipe comprises a first distance.

Lastly, there is a baffle. The baffle has an upper extent and a lower extent. The baffle has an inflow surface and an outflow surface, with the width there between.

The upper extent of the baffle is located at the internal surface of the rearward portion of the upper portion of the outflow pipe. The lower extent of the baffle has a linear configuration.

The lower extent of the baffle is located at a second distance from the internal surface of the lower portion of the intermediate pipe. The second distance of the lower extent of the baffle to the internal surface of the lower portion of the intermediate pipe is less than the first distance of the radius of curvature of the intermediate pipe.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drain P-trap which has all of the advantages of the prior art drain traps and none of the disadvantages.

It is another object of the present invention to provide a new and improved drain P-trap which may be easily and efficiently manufactured and marketed.

It is further object of the present invention to provide a new and improved drain P-trap which is of durable and reliable constructions.

An even further object of the present invention is to provide a new and improved drain P-trap which is susceptible of a low cost of manufacture with regard to both materials and labor, and which accordingly is then susceptible of low prices of sale to the consuming public, thereby making such drain P-trap economically available to the buying public.

Even still another object of the present invention is to provide a drain P-trap for a P-trap having an internal baffle.

Lastly, it is an object of the present invention to provide a new and improved drain P-trap, which has an inflow pipe and an intermediate pipe and an outflow pipe forming a passageway there through. The intermediate pipe has an internal surface with a radius of curvature. The outflow pipe is coupled to the intermediate pipe. There is a baffle located within the passageway. The baffle has a lower extent which is a second distance from the first radius of curvature of the internal surface of the intermediate pipe. The second distance is less than the first distance of the radius of curvature of the intermediate pipe. It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view taken along line 3-3 of FIG. 2.

FIG. 4 is a view taken along line 4-4 of FIG. 3.

DESCRIPTION OF THE PREFERRED EMBODIMENT

Figure 1:
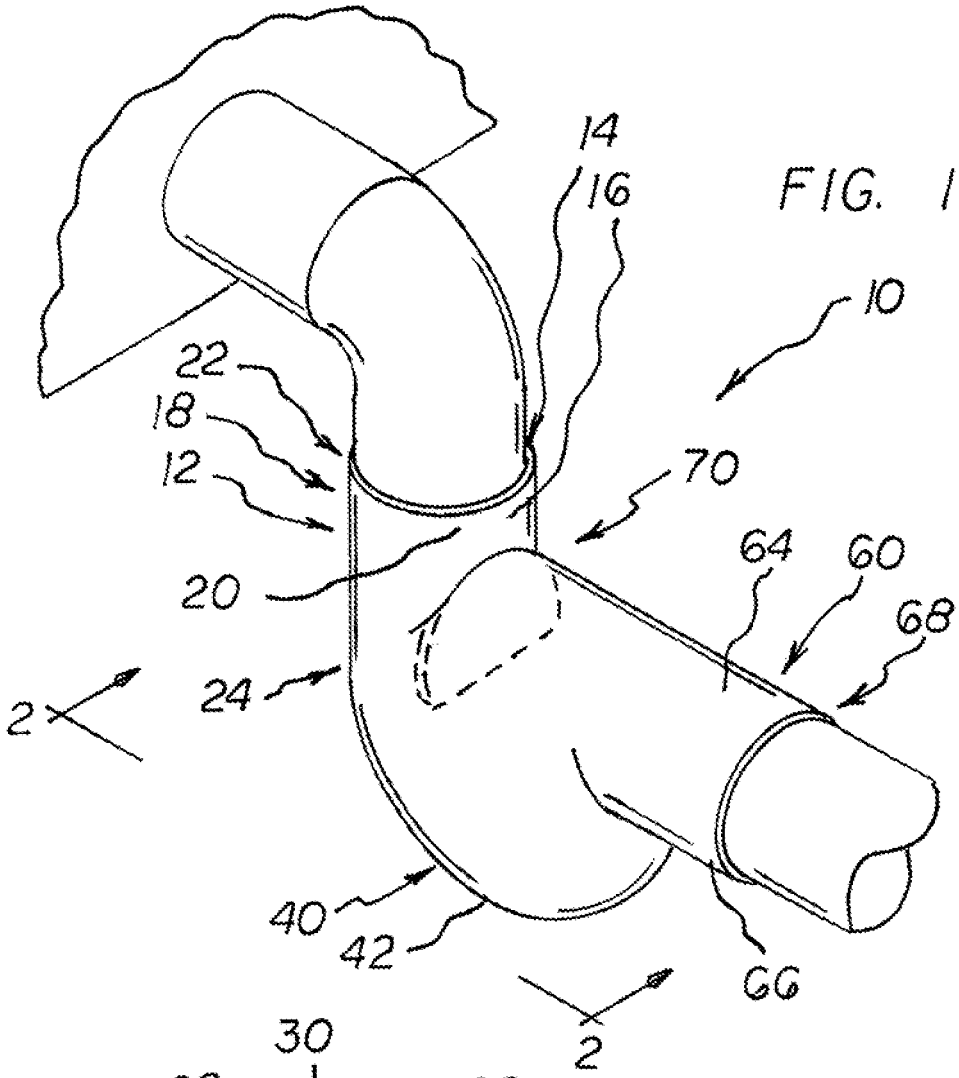
FIG. 1 is a top left perspective view of the drain P-trap.
Figure 2:
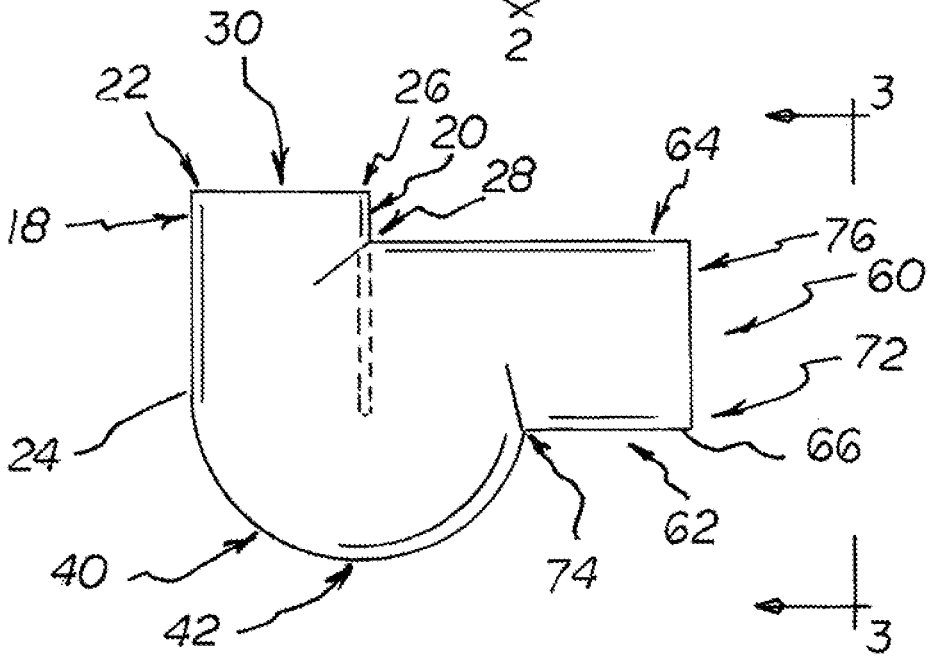
FIG. 2 is a view taken along line 2-2 of FIG. 1.
Figure 5:
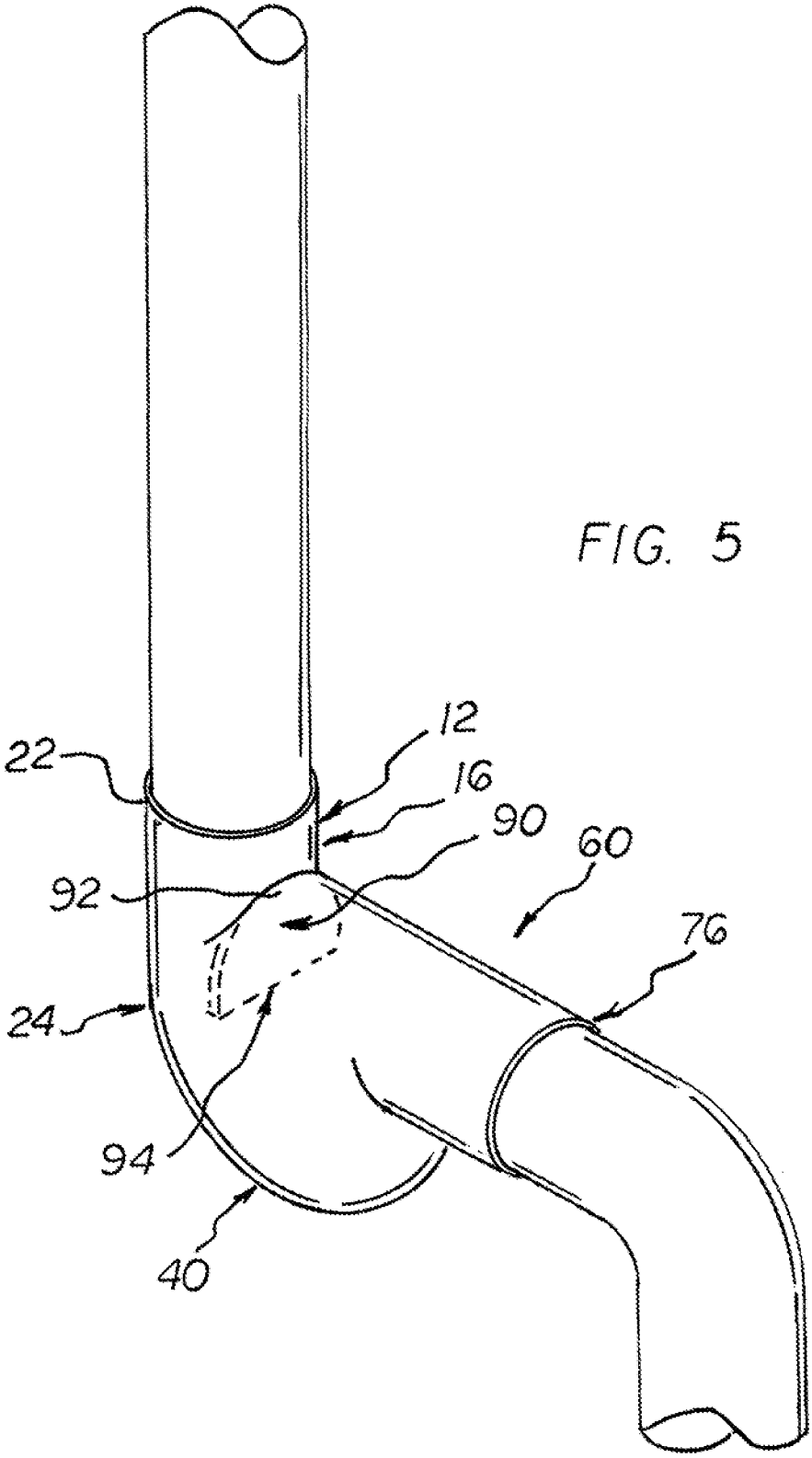
FIG. 5 is a top left perspective view of the drain P-trap which is coupled to a pipe at the inflow pipe and to a second pipe at the outflow pipe The same reference numerals refer to the same parts throughout the various Figures.

With reference now to the drawings, and in particular to FIG. 1 thereof, the preferred embodiment of the new and improved drain P-trap, embodying the principles and concepts of the present invention and generally designated by the reference numeral 10, will be described.

The present invention, the drain P-trap 10 is comprised of a plurality of components. Such components in their broadest context include an inflow pipe, an intermediate pipe, an outflow pipe, and a baffle. Such components are individually configured and correlated with respect to each other so as to attain the desired objective.

A drain P-trap 10, comprising several components, in combination is herein described.

There is first provided an inflow pipe 12. The inflow pipe has a first internal diameter. The inflow pipe has a round configuration 14. The inflow pipe has a continuous circumferential wall 16, with a rearward portion 18 and a forward portion 20. The rearward portion of the inflow pipe has an upper extent 22 and a lower extent 24. The forward portion of the inflow pipe has an upper extent 26 and a lower extent 28.

The upper extent of the rearward portion of the inflow pipe and the upper extent of the forward portion of the inflow pipe are continuous, thereby forming a round opening 30 of the inflow pipe. The inflow pipe has an internal surface 32 and an external surface 34 with a width there between.

There is next an intermediate pipe 40. The intermediate pipe has a lower surface 42. The intermediate pipe lower surface has a curved rearward portion 44 and a curved forward portion 46. The curved rearward portion of the lower surface of the intermediate pipe is continuous with the lower extent of the rearward portion of the inflow pipe.

The intermediate pipe has an internal surface 48 which is continuous with the internal surface of the inflow pipe. The intermediate pipe has an external surface 50 which is continuous with the external surface of the inflow pipe.

The intermediate pipe has the width between the internal surface of the intermediate pipe and the external surface of the intermediate pipe. The intermediate pipe internal surface of the lower surface has a first radius of curvature 52.

There is an outflow pipe 60. The outflow pipe has the first diameter. The outflow pipe has a round configuration. The outflow pipe has a continuous circumferential wall 62, with an upper portion 64 and a lower portion 66.

The upper portion of the outflow pipe has a forward extent 68 and a rearward extent 70. The lower portion of the outflow pipe has a forward extent 72 and a rearward extent 74. The forward extent of the upper portion of the outflow pipe and the forward extent of the lower portion of the inflow pipe are continuous with each other, thereby forming a round opening 76 of the outflow pipe.

The upper portion of the outflow pipe and the lower portion of the outflow pipe have an internal surface 78 and an external surface 80, with the width there between.

The radius of curvature of the internal surface of the intermediate pipe runs from the internal surface of the lower extent of the rearward portion of the inflow pipe to the internal surface of the rearward portion of the lower portion of the outflow pipe. The radius of curvature of the internal surface of the intermediate pipe comprises a first distance.

Lastly, there is a baffle 90. The baffle has an upper extent 92 and a lower extent. The baffle has an inflow surface 94 and an outflow surface 96, with the width there between.

The upper extent of the baffle is located at the internal surface of the rearward portion of the upper portion of the outflow pipe. The lower extent of the baffle has a linear configuration.

The lower extent of the baffle is located at a second distance from the internal surface of the lower portion of the intermediate pipe. The second distance of the lower extent of the baffle to the internal surface of the lower portion of the intermediate pipe is less than the first distance of the radius of curvature of the intermediate pipe.

The herein described drain P-trap differs from the well known myriad of drain P-traps which exist in the marketplace. The baffle is the key to the different function of the herein described device.

The P-trap has a lower top to bottom profile, which is possible because of the baffle inside of the internal passageway. The lower extent of the baffle is located in alignment with the internal surface of the lower portion of the outflow. The distance from the lower extent of the baffle to the internal surface of the intermediate pipe is less than the diameter of the opening of the inflow pipe and the outflow pipe.

The lessening of distance between the lower extent of the baffle and the internal surface of the intermediate pipe, which is less than the diameter of the inflow pipe and the outflow pipe, causes an increase in the rate of flow through the passageway between the baffle and the lower internal surface of the intermediate pipe. The reduced distance between the baffle lower extent and the intermediate pipe internal wall effectively causes a reduction in pipe diameter. Even slow flowing liquid increases in relative velocity as it moves through the smaller opening, thereby causing a flushing action of the intermediate pipe. The flushing action, caused by the reduction in effective pipe diameter, causes a cleaning of the P-trap of any debris and algae buildup.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drain P-trap, comprising, in combination;

an inflow pipe having a first internal diameter;

an intermediate pipe having a lower surface, the lower surface of the intermediate pipe having an internal surface, the internal surface of the intermediate pipe having a first radius of curvature, the first radius of curvature of the internal surface of the intermediate pipe being a first distance, the intermediate pipe being operatively coupled to the inflow pipe;

an outflow pipe having the internal first diameter, with the inflow pipe and the intermediate pipe and the outflow pipe forming an internal passageway through the P-trap, the outflow pipe having a lower portion with the lower portion of the outflow pipe having an internal surface; and, a baffle located within the internal passageway of the P-trap, with the baffle having an upper extent and a lower extent, the baffle having an inflow surface and an outflow surface with the width there between, the lower extent of the baffle being a second distance from the first radius of curvature of the internal surface of the intermediate pipe, the second distance of the lower extent of the baffle to the internal surface of the intermediate pipe being less than the first distance of the radius of curvature of the intermediate pipe, the lower extent of the baffle is located in alignment with the internal surface of the lower portion of the outflow pipe.

2. The drain P-trap as described in claim 1, with the drain P-trap further comprising:

the inflow pipe having a round configuration, the inflow pipe having a continuous circumferential wall with a rearward portion and a forward portion;

the intermediate pipe lower surface having a curved rearward portion and a curved forward portion, the curved rearward portion of the lower surface of the intermediate pipe being continuous with the inflow pipe;

the outflow pipe having a round configuration, the outflow pipe having a continuous circumferential wall with an upper portion and a lower portion;

the upper extent of the baffle being located at the upper portion of the outflow pipe; and, the lower extent of the baffle having a linear configuration with the lower extent of the baffle being located at a second distance from the internal surface of the lower portion of the intermediate pipe.

3. The drain P-trap as described in claim 2, with the drain P-trap further comprising:

the rearward portion of the inflow pipe having an upper extent and a lower extent, the forward portion of the inflow pipe having an upper extent and a lower extent;

the curved rearward portion of the lower surface of the intermediate pipe being continuous with the lower extent of the rearward portion of the inflow pipe; and, the upper portion of the outflow pipe having an forward extent and a rearward extent, the lower portion of the outflow pipe having a forward extent and a rearward extent.

4. The drain P-trap as described in claim 3, with the drain P-trap further comprising:

the upper extent of the rearward portion of the inflow pipe and the upper extent of the forward portion of the inflow pipe being continuous together thereby forming a round opening of the inflow pipe, the inflow pipe having an internal surface and an external surface with a width there between;

the intermediate pipe internal surface being continuous with the internal surface of the inflow pipe, the intermediate pipe having an external surface which is continuous with the external surface of the inflow pipe;

the forward extent of the upper portion of the outflow pipe and the forward extent of the lower portion of the inflow pipe being continuous with each other thereby forming a round opening of the outflow pipe, the upper portion of the outflow pipe and the lower portion of the outflow pipe having an internal surface and an external surface with the width there between; and, the upper extent of the baffle being located at the internal surface of the rearward portion of the upper portion of the outflow pipe.

5. The drain P-trap as described in claim 4, with the drain P-trap further comprising:

the intermediate pipe having the width between the internal surface of the intermediate pipe and the external surface of the intermediate pipe; and, the radius of curvature of the internal surface of the intermediate pipe running from the internal surface of the lower extent of the rearward portion of the inflow pipe to the internal surface of the rearward portion of the lower portion of the outflow pipe.

6. A drain P-trap, comprising, in combination:

an inflow pipe having a first diameter;

an intermediate pipe, the intermediate pipe having an internal surface with a radius of curvature, the radius of curvature having a first distance, the intermediate pipe being operatively coupled to the inflow pipe;

an outflow pipe having a first diameter, with the inflow pipe and the intermediate pipe and the outflow pipe forming an internal passageway through the P-trap, the outflow pipe having a lower portion with the lower portion of the outflow pipe having an internal surface; and, a baffle located within the internal passageway of the P-trap, the baffle having a lower extent with the lower extent of the baffle being a second distance from the first radius of curvature of the internal surface of the intermediate pipe, the second distance of the lower extent of the baffle to the internal surface of the intermediate pipe being less than the first distance of the radius of curvature of the intermediate pipe, the second distance of the lower extent of the baffle to the internal surface of the intermediate pipe being less than the first diameter of the inflow pipe and the outflow pipe, the lower extent of the baffle is located in alignment with the internal surface of the lower portion of the outflow pipe.

* * * * *